US011250782B1

(12) United States Patent
Liu et al.

(10) Patent No.: US 11,250,782 B1
(45) Date of Patent: Feb. 15, 2022

(54) PIXEL CIRCUIT, PIXEL DRIVING METHOD AND DISPLAY DEVICE

(71) Applicant: BOE TECHNOLOGY GROUP CO., LTD., Beijing (CN)

(72) Inventors: Weixing Liu, Beijing (CN); Zhiqiang Xu, Beijing (CN); Tieshi Wang, Beijing (CN); Wei Qin, Beijing (CN); Wanpeng Teng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/213,557

(22) Filed: Mar. 26, 2021

(30) Foreign Application Priority Data

Aug. 27, 2020 (CN) ..... 202010878841.8

(51) Int. Cl.
*G09G 3/3258* (2016.01)
*G09G 3/3241* (2016.01)

(52) U.S. Cl.
CPC ..... *G09G 3/3258* (2013.01); *G09G 3/3241* (2013.01); *G09G 2310/061* (2013.01)

(58) Field of Classification Search
CPC .. G09G 3/3233; G09G 3/32; G09G 2320/045; G09G 3/3258; G09G 3/3241
See application file for complete search history.

(56) References Cited

U.S. PATENT DOCUMENTS

| | | | | |
|---|---|---|---|---|
| 7,508,361 | B2 * | 3/2009 | Uchino | G09G 3/3233 345/76 |
| 7,995,008 | B2 * | 8/2011 | Miwa | G09G 3/325 345/76 |
| 8,531,362 | B2 * | 9/2013 | Chung | G09G 3/3233 345/77 |
| 8,963,441 | B2 * | 2/2015 | Tan | G09G 3/32 315/226 |
| 9,119,259 | B2 * | 8/2015 | Tan | H05B 47/00 |
| 9,449,544 | B2 * | 9/2016 | Duan | G09G 3/3241 |
| 9,536,472 | B2 * | 1/2017 | Park | G09G 3/3233 |
| 9,570,008 | B2 * | 2/2017 | Lee | G09G 3/325 |
| 10,068,526 | B2 * | 9/2018 | Xu | G09G 3/3241 |
| 10,186,196 | B2 * | 1/2019 | Sun | G09G 3/32 |
| 10,726,788 | B2 * | 7/2020 | Qin | G09G 3/3275 |
| 2004/0263057 | A1 * | 12/2004 | Uchino | G09G 3/3233 313/500 |
| 2006/0221009 | A1 * | 10/2006 | Miwa | G09G 3/325 345/76 |

(Continued)

*Primary Examiner* — Michael J Jansen, II
(74) *Attorney, Agent, or Firm* — Westman, Champlin & Koehler, P.A.

(57) ABSTRACT

A pixel circuit, a pixel driving method, and a display device are provided. The pixel circuit includes a light emitting element, a first voltage control circuit, a second voltage control circuit, a driving circuit, a first energy storage circuit, a data writing circuit, and a reset circuit. The first voltage control circuit includes a first control transistor, the driving circuit includes a driving transistor, and a difference between a threshold voltage of the first control transistor and a threshold voltage of the driving transistor is within a first range. The first voltage control circuit controls a potential of a first control node under control of a reset control signal; and the second voltage control circuit controls a potential of a second control node under control of the potential of the first control node.

20 Claims, 3 Drawing Sheets

(56) References Cited

U.S. PATENT DOCUMENTS

| | | | | |
|---|---|---|---|---|
| 2013/0002633 | A1* | 1/2013 | Chung | G09G 3/3233 345/211 |
| 2013/0082906 | A1* | 4/2013 | Toyomura | G09G 3/2014 345/55 |
| 2013/0083000 | A1* | 4/2013 | Toyomura | G09G 3/3233 345/212 |
| 2013/0134897 | A1* | 5/2013 | Tan | H05B 45/60 315/226 |
| 2013/0147386 | A1* | 6/2013 | Tan | H05B 47/00 315/226 |
| 2015/0070341 | A1* | 3/2015 | Lee | G09G 3/325 345/211 |
| 2016/0217735 | A1* | 7/2016 | Park | G09G 3/2003 |
| 2016/0240127 | A1* | 8/2016 | Duan | G09G 3/3241 |
| 2017/0193904 | A1* | 7/2017 | Xu | G09G 3/3258 |
| 2018/0166009 | A1* | 6/2018 | Sun | G09G 3/3233 |
| 2019/0311676 | A1* | 10/2019 | Chaji | G09G 3/3233 |
| 2020/0051503 | A1* | 2/2020 | Qin | G09G 3/3233 |
| 2021/0210003 | A1* | 7/2021 | Kim | G09G 3/2014 |

* cited by examiner

PIXEL CIRCUIT, PIXEL DRIVING METHOD AND DISPLAY DEVICE

CROSS-REFERENCE TO RELATED APPLICATION

This application claims a priority to Chinese Patent Application No. 202010878841.8 filed on Aug. 27, 2020, the disclosure of which is incorporated in its entirety by reference herein.

TECHNICAL FIELD

The present disclosure relates to the field of display technology, and in particular to a pixel circuit, a pixel driving method, and a display device.

BACKGROUND

Organic light emitting diode panels have characteristics of being bendable, high contrast, low power consumption, etc., and have attracted extensive attention. A pixel circuit is core technical content of an organic light emitting diode (Organic Light Emitting Diode, OLED) panel. In the OLED panel, the OLED is driven to emit light by a current generated by a driving transistor in a pixel circuit. However, there are still areas to be improved for the pixel circuit in the related technologies.

SUMMARY

The present disclosure provides a pixel circuit including a light emitting element, a first voltage control circuit, a second voltage control circuit, a driving circuit, a first energy storage circuit, a data writing circuit, and a reset circuit;

the first voltage control circuit includes a first control transistor, the driving circuit includes a driving transistor, and a difference between a threshold voltage of the first control transistor and a threshold voltage of the driving transistor is within a first range;

the first voltage control circuit is configured to control a potential of a first control node under control of a reset control signal on a reset control line;

the second voltage control circuit is electrically connected to the first control node and a second control node, and is configured to control a potential of the second control node under control of the potential of the first control node, and the second control node is electrically connected to a first terminal of the driving circuit;

the first energy storage circuit is electrically connected to a control terminal of the driving circuit, and is configured to store electric energy;

the reset circuit is configured to reset a potential of the control terminal of the driving circuit under control of the reset control signal, to cause the driving circuit to disconnect connection between the first terminal of the driving circuit and the second terminal of the driving circuit;

the data writing circuit is configured to control a data voltage on a data line to be written to the control terminal of the driving circuit under control of a data writing control signal on a data writing control line; and the second terminal of the driving circuit is electrically connected to the light emitting element, and the driving circuit is configured to generate, under control of the potential of the control terminal of the driving circuit, a driving current for driving the light emitting element to emit light.

In some embodiments, the first voltage control circuit is configured to control the potential of the first control node to be related to an absolute value of the threshold voltage of the first control transistor under the control of the reset control signal, and the second voltage control circuit is configured to control the potential of the second control node to be related to the absolute value of the threshold voltage of the first control transistor under the control of the potential of the first control node, so as to cause the driving current to be unrelated to the threshold voltage of the driving transistor.

In some embodiments, the first voltage control circuit includes a second control transistor and a first storage capacitor;

a control electrode of the second control transistor is electrically connected to the reset control line, a first electrode of the second control transistor is electrically connected to a first voltage terminal, and a second electrode of the second control transistor is electrically connected to the first control node;

a control electrode of the first control transistor and a second electrode of the first control transistor are electrically connected to a second voltage terminal, and a first electrode of the first control transistor is electrically connected to the first control node; and a first terminal of the first storage capacitor is connected to the first control node, and a second terminal of the first storage capacitor is electrically connected to the second voltage terminal.

In some embodiments, the second voltage control circuit includes a current source, a third control transistor, and a fourth control transistor;

a control electrode of the third control transistor is electrically connected to the current source, a first electrode of the third control transistor is electrically connected to a first voltage terminal, and a second electrode of the third control transistor is electrically connected to the second control node;

a control electrode of the fourth control transistor is electrically connected to the first control node, a first electrode of the fourth control transistor is electrically connected to the second control node, and a second electrode of the fourth control transistor is electrically connected to the current source; and the current source is configured to provide a current flowing from the third control transistor to the fourth control transistor.

In some embodiments, the current source includes an operational amplifier, a first resistor, a second resistor, a third resistor, and a second storage capacitor;

a non-inverting input terminal of the operational amplifier is electrically connected to an input voltage terminal via the first resistor, a first terminal of the second storage capacitor is electrically connected to the non-inverting input terminal of the operational amplifier, and a second terminal of the second storage capacitor is electrically connected to a third voltage terminal;

an output terminal of the operational amplifier is electrically connected to a first terminal of the second resistor, a second terminal of the second resistor is electrically connected to a first terminal of the third resistor and an inverting input terminal of the operational amplifier, and a second terminal of the third resistor is electrically connected to the third voltage terminal; and the first terminal of the third resistor is electrically connected to the control electrode of the third control transistor and the second electrode of the fourth control transistor.

In some embodiments, the current source is a constant current source.

In some embodiments, the reset circuit includes a reset transistor; and a control electrode of the reset transistor is electrically connected to the reset control line, a first electrode of the reset transistor is electrically connected to a reset voltage terminal, and a second electrode of the reset transistor is electrically connected to the control terminal of the driving circuit.

In some embodiments, the data writing circuit includes a data writing transistor; and a control electrode of the data writing transistor is electrically connected to the data writing control line, a first electrode of the data writing transistor is electrically connected to the data line, and a second electrode of the data writing transistor is electrically connected to the control terminal of the driving circuit.

In some embodiments, the first energy storage circuit includes a second capacitor; and a first terminal of the second capacitor is electrically connected to the control terminal of the driving circuit, and a second terminal of the second capacitor is electrically connected to a first voltage terminal.

In some embodiments, a control electrode of the driving transistor is electrically connected to the control terminal of the driving circuit, a first electrode of the driving transistor is electrically connected to the second control node, and a second electrode of the driving transistor is electrically connected to the light emitting element.

In some embodiments, the threshold voltage of the first control transistor is equal to the threshold voltage of the driving transistor.

The present disclosure also provides a pixel driving method, which is applied to the above mentioned pixel circuit, and the pixel driving method includes:

in a reset stage of a display period, under control of the reset control signal on the reset control line, controlling, by the first voltage control circuit, the potential of the first control node; under control of the potential of the first control node, controlling, by the second voltage control circuit, the potential of the second control node; under control of the reset control signal, resetting, by the reset circuit, the potential of the control terminal of the driving circuit, to cause the driving circuit to disconnect connection between the first terminal of the driving circuit and the second terminal of the driving circuit.

In some embodiments, the controlling, by the first voltage control circuit, the potential of the first control node, under control of the reset control signal on the reset control line includes: under the control of the reset control signal on the reset control line, controlling, by the first voltage control circuit, the potential of the first control node to be related to an absolute value of the threshold voltage of the first control transistor; and the controlling, by the second voltage control circuit, the potential of the second control node, under control of the potential of the first control node includes: under the control of the potential of the first control node, controlling, by the second voltage control circuit, the potential of the second control node to be related to the absolute value of the threshold voltage of the first control transistor.

In some embodiments, the display period includes: the reset stage and N sequential display stages after the reset stage, and the display stage includes a data writing stage and a light emitting stage in sequence, where N is a positive integer;

in the data writing stage, under the control of the data writing control signal on the data writing control line, the data writing circuit writes the data voltage to the control terminal of the driving circuit;

in the light emitting stage, under the control of the potential of the control terminal of the driving circuit, the driving circuit generates the driving current for driving the light emitting element to emit light according to the potential of the control terminal and the potential of the first terminal of the driving circuit, and makes the driving current be unrelated to the threshold voltage of the driving transistor included in the driving circuit.

In some embodiments, N is greater than or equal to 2 and less than or equal to 8.

In some embodiments, the first voltage control circuit includes a second control transistor and a first storage capacitor; and in the reset stage, the controlling, under the control of the reset control signal on the reset control line, by the first voltage control circuit, the potential of the first control node to be related to an absolute value of the threshold voltage of the first control transistor includes:

in the reset stage, under the control of the reset control signal, the second control transistor is turned on to charge the first storage capacitor by a current flowing through the second control transistor, so as to increase the potential of the first control node, until the potential of the first control node becomes $V2+|Vth_6|$, where V2 is a second voltage provided by the second voltage terminal, and Vth_6 is the threshold voltage of the first control transistor.

In some embodiments, the second voltage control circuit includes a current source, a third control transistor, and a fourth control transistor; and in the reset stage, the controlling, under the control of the potential of the first control node, by the second voltage control circuit, the potential of the second control node to be related to the absolute value of the threshold voltage of the first control transistor includes:

in the reset stage, the current source provides a current flowing from the third control transistor to the fourth control transistor and controls the third control transistor and the fourth control transistor to operate in a saturation region, to cause a change in a potential of a source of the fourth control transistor to be equal to a change in a potential of a gate of the fourth control transistor, so as to cause the potential of the second control node to be related to the absolute value of the threshold voltage of the first control transistor.

In some embodiments, the threshold voltage of the first control transistor is equal to the threshold voltage of the driving transistor.

The present disclosure also provides a display device including the above mentioned pixel circuit.

BRIEF DESCRIPTION OF THE DRAWINGS

In order to explain the technical solutions of the embodiments of the present disclosure more clearly, the drawings used in the descriptions of the embodiments of the present disclosure will be briefly introduced hereinafter. Apparently, the drawings in the following descriptions are only some embodiments of the present disclosure. For those of ordinary skill in the art, other drawings can be obtained based on these drawings without any creative efforts.

DETAILED DESCRIPTION

Figure 1:
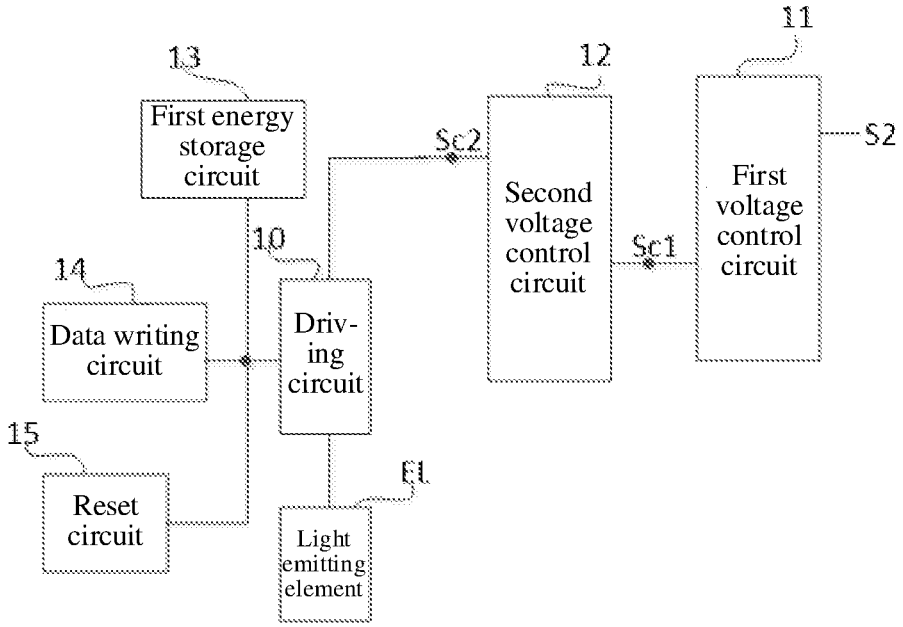
FIG. 1 is a schematic diagram of a structure of a pixel circuit in some embodiments of the present disclosure.

The technical solutions in the embodiments of the present disclosure will be clearly and completely described hereinafter with reference to the drawings of the embodiments of the present disclosure. Apparently, the described embodiments are only a part rather than all of the embodiments of the present disclosure. Based on the embodiments in the present disclosure, all other embodiments obtained by a person of ordinary skill in the art without any creative efforts fall within the protection scope of the present disclosure.

Due to limitation of the process and increase of the use time, different degrees of drift may occur for threshold voltages of driving transistors, hence the problem of uneven brightness of OLEDs may be caused in the OLED panel.

The pixel circuit in the related technologies cannot increase the charging rate and compensate the threshold voltage of the driving transistor at the same time. In view of the above, embodiments of the present disclosure provide a pixel circuit, a pixel driving method, and a display device.

Transistors used in embodiments of the present disclosure may all be triodes, thin film transistors or field effect transistors or other devices with the same characteristics. In the embodiments of the present disclosure, in order to distinguish two electrodes of a transistor other than a control electrode, one of the electrodes is referred to as a first electrode, and the other one of the electrodes is referred to as a second electrode.

In actual operation, when the transistor is a triode, the control electrode may be a base, the first electrode may be a collector, and the second electrode may be an emitter; or, the control electrode may be a base, the first electrode may be an emitter, and the second electrode may be a collector.

In actual operation, when the transistor is a thin film transistor or a field effect transistor, the control electrode may be a gate, the first electrode may be a drain, and the second electrode may be a source; or the control electrode may be a gate, the first electrode may be a source, and the second electrode may be a drain.

Some embodiments of the present disclosure provide a pixel circuit including a light emitting element, a first voltage control circuit, a second voltage control circuit, a driving circuit, a first energy storage circuit, a data writing circuit, and a reset circuit;

the first voltage control circuit includes a first control transistor, the driving circuit includes a driving transistor, and a difference between a threshold voltage of the first control transistor and a threshold voltage of the driving transistor is within a first range;

the first voltage control circuit is configured to control a potential of a first control node under control of a reset control signal on a reset control line;

the second voltage control circuit is electrically connected to the first control node and a second control node, and is configured to control a potential of the second control node under control of the potential of the first control node, and the second control node is electrically connected to a first terminal of the driving circuit;

the first energy storage circuit is electrically connected to a control terminal of the driving circuit, and is configured to store electric energy;

the reset circuit is configured to reset a potential of the control terminal of the driving circuit under control of the reset control signal, to cause the driving circuit to disconnect connection between the first terminal of the driving circuit and the second terminal of the driving circuit;

the data writing circuit is configured to control a data voltage on a data line to be written to the control terminal of the driving circuit under control of a data writing control signal on a data writing control line; and the second terminal of the driving circuit is electrically connected to the light emitting element, and the driving circuit is configured to generate, under control of the potential of the control terminal of the driving circuit, a driving current for driving the light emitting element to emit light.

In some embodiments, the first voltage control circuit is configured to control the potential of the first control node to be related to an absolute value of the threshold voltage of the first control transistor under the control of the reset control signal, and the second voltage control circuit is configured to control the potential of the second control node to be related to the absolute value of the threshold voltage of the first control transistor under the control of the potential of the first control node, so as to cause the driving current to be unrelated to the threshold voltage of the driving transistor.

The pixel circuit according to the embodiments of the present disclosure includes a light emitting element EL, a first voltage control circuit 11, a second voltage control circuit 12, a driving circuit 10, a first energy storage circuit 13, a data writing circuit 14, and a reset circuit 15.

The first voltage control circuit 11 is electrically connected to a reset control line S2 and a first control node Sc1, and is configured to control, under the control of a reset control signal on the reset control line S2, a potential of the first control node Sc1 to be related to an absolute value of a threshold voltage of a first control transistor included in the first voltage control circuit 11, and a difference between the threshold voltage of the first control transistor and a threshold voltage of a driving transistor included in the driving circuit 10 is in a first range. The first range is a predetermined range.

The second voltage control circuit 12 is electrically connected to the first control node Sc1 and a second control node Sc2, and is configured to control, under the control of the potential of the first control node Sc1, a potential of the second control node Sc2 to be related to the absolute value of the threshold voltage of the first control transistor; the second control node Sc2 is electrically connected to a first terminal of the driving circuit 10.

The first energy storage circuit 13 is electrically connected to a control terminal of the driving circuit 10, and is configured to store electric energy.

The reset circuit 15 is electrically connected to the reset control line S2 and the control terminal of the driving circuit 10, and is configured to reset a potential of the control terminal of the driving circuit 10 under the control of the reset control signal, to cause the driving circuit 10 to disconnect connection between the first terminal of the driving circuit 10 and the second terminal of the driving circuit 10.

The data writing circuit 14 is electrically connected to a data writing control line S1, a data line Data, and the control terminal of the driving circuit 10, and is configured to control a data voltage on the data line Data to be written to the control terminal of the driving circuit 10 under control of a data writing control signal on the data writing control line S1.

The second terminal of the driving circuit 10 is electrically connected to the light emitting element EL, and the driving circuit 10 is configured to generate, under the control of the potential of the control terminal of the driving circuit, a driving current for driving the light emitting element EL to emit light.

The pixel circuit described in the embodiments of the present disclosure can compensate the threshold voltage of the driving transistor included in the driving circuit before the data writing stage, so that the driving current of the driving circuit for driving the light emitting element to emit light is unrelated to the threshold voltage of the driving transistor. In addition, the charging rate of the pixel circuit is improved, the response rate is fast, and it may be used in a large-size display.

In some embodiments of the present disclosure, the predetermined range may be selected according to actual conditions.

In some embodiments of the present disclosure, the difference between the threshold voltage of the first control transistor and the threshold voltage of the driving transistor included in the driving circuit 10 is within a predetermined range, for example, the threshold voltage of the first control transistor is enabled to be equal to the threshold voltage of the driving transistor, or the threshold voltage of the first control transistor and the threshold voltage of the driving transistor are approximately equal.

When the pixel circuit according to the embodiments of the present disclosure is in operation, the display period may include a reset stage and a data writing stage, and a light emitting stage in sequence.

In the reset stage, under the control of the reset control signal on the reset control line S2, the first voltage control circuit 11 controls the potential of the first control node Sc1 to be related to the absolute value of the threshold voltage of the first control transistor; the second voltage control circuit 12 controls, under the control of the potential of the first control node Sc1, the potential of the second control node Sc2 to be related to the absolute value of the threshold voltage of the first control transistor; under the control of the reset control signal, the reset circuit 15 resets the potential of the control terminal of the driving circuit 10, so that the driving circuit 10 disconnects the connection between the first terminal of the driving circuit 10 and the second terminal of the driving circuit 10.

In the data writing stage, under the control of the data writing control signal on the data writing control line S1, the data writing circuit 14 writes the data voltage to the control terminal of the driving circuit 10.

In the light emitting stage, the driving circuit 10 generates, under the control of the potential of the control terminal of the driving circuit, a driving current for driving the light emitting element EL to emit light according to the potential of the control terminal and the potential of the first terminal of the driving circuit 10, and causes the driving current to be unrelated to the threshold voltage of the driving transistor included in the driving circuit.

In some embodiments, the first voltage control circuit includes the first control transistor, a second control transistor, and a first storage capacitor.

A control electrode of the second control transistor is electrically connected to the reset control line, a first electrode of the second control transistor is electrically connected to a first voltage terminal, and a second electrode of the second control transistor is electrically connected to the first control node.

A control electrode of the first control transistor and a second electrode of the first control transistor are electrically connected to a second voltage terminal, and a first electrode of the first control transistor is electrically connected to the first control node.

A first terminal of the first storage capacitor is connected to the first control node, and a second terminal of the first storage capacitor is electrically connected to the second voltage terminal.

In specific implementations, the second voltage control circuit includes a current source, a third control transistor, and a fourth control transistor.

A control electrode of the third control transistor is electrically connected to the current source, a first electrode of the third control transistor is electrically connected to the first voltage terminal, and a second electrode of the third control transistor is electrically connected to the second control node.

A control electrode of the fourth control transistor is electrically connected to the first control node, a first electrode of the fourth control transistor is electrically connected to the second control node, and a second electrode of the fourth control transistor is electrically connected to the current source.

The current source is configured to provide a current flowing from the third control transistor to the fourth control transistor.

In some embodiments, the reset circuit includes a reset transistor.

A control electrode of the reset transistor is electrically connected to the reset control line, a first electrode of the reset transistor is electrically connected to a reset voltage terminal, and a second electrode of the reset transistor is electrically connected to the control terminal of the driving circuit.

In some embodiments, the data writing circuit includes a data writing transistor.

A control electrode of the data writing transistor is electrically connected to a data writing control line, a first electrode of the data writing transistor is electrically connected to a data line, and a second electrode of the data writing transistor is electrically connected to the control terminal of the driving circuit.

In some embodiments, the first energy storage circuit includes a second capacitor.

A first terminal of the second capacitor is electrically connected to the control terminal of the driving circuit, and a second terminal of the second capacitor is electrically connected to the first voltage terminal.

In some embodiments of the present disclosure, the driving circuit may include the driving transistor.

A control electrode of the driving transistor is electrically connected to the control terminal of the driving circuit, a first electrode of the driving transistor is electrically connected to the second control node, and a second electrode of the driving transistor is electrically connected to the light emitting element.

In some embodiments of the present disclosure, the light emitting element may be an organic light emitting diode, which is not limited thereto.

Figure 2:
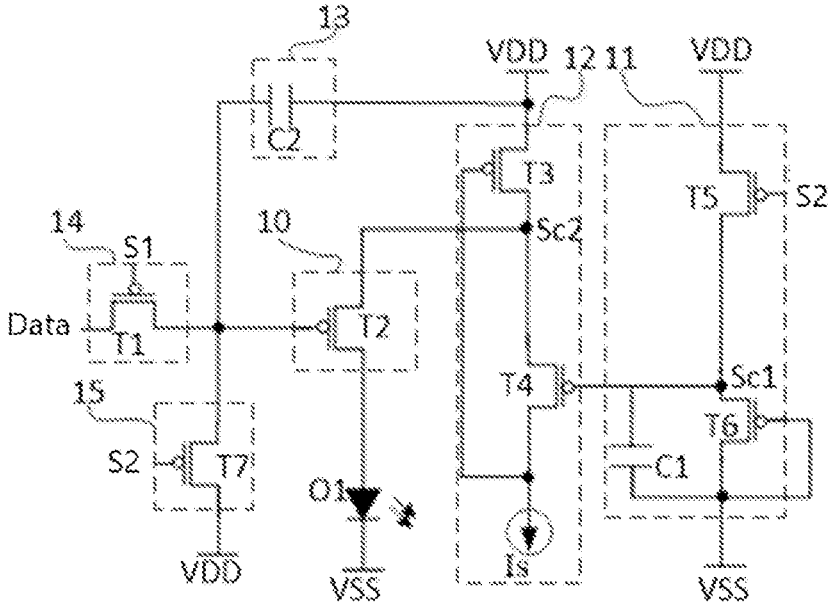
FIG. 2 is a circuit diagram of a pixel circuit in some embodiments of the present disclosure.

As shown in FIG. 2, based on the embodiments of the pixel circuit shown in FIG. 1, in a specific embodiment of the pixel circuit in the present disclosure, the light emitting element may be an organic light emitting diode O1.

The first voltage control circuit 11 may include a first control transistor T6, a second control transistor T5, and a first storage capacitor C1.

The gate of the second control transistor T5 is electrically connected to the reset control line S2, the source of the second control transistor T5 is electrically connected to the high voltage terminal, and the drain of the second control transistor T5 is electrically connected to the first control node Sc1; the high voltage terminal is configured to provide a high voltage VDD.

The gate of the first control transistor T6 and the drain of the first control transistor T6 are electrically connected to the low voltage terminal, and the source of the first control transistor T6 is electrically connected to the first control node Sc1; the low voltage terminal is configured to provide a low voltage VSS.

The first terminal of the first storage capacitor C1 is connected to the first control node Sc1, and the second terminal of the first storage capacitor C1 is electrically connected to the low voltage terminal.

The second voltage control circuit 12 may include a current source Is, a third control transistor T3, and a fourth control transistor T4.

The gate of the third control transistor T3 is electrically connected to the current source Is, the source of the third control transistor T3 is electrically connected to the high voltage terminal, and the drain of the third control transistor T3 is electrically connected to the second control node Sc2.

The gate of the fourth control transistor T4 is electrically connected to the first control node Sc1, the source of the fourth control transistor T4 is electrically connected to the second control node Sc2, and the drain of the fourth control transistor T4 is electrically connected to the current source Is.

The current source Is is configured to provide a current flowing from the third control transistor T3 to the fourth control transistor T4.

The reset circuit 15 may include a reset transistor T7. The driving circuit 10 may include a driving transistor T2.

The gate of the reset transistor T7 is electrically connected to the reset control line S2, the source of the reset transistor T7 is electrically connected to the high voltage terminal, and the drain of the reset transistor T7 is electrically connected to the gate of the driving transistor T2.

The data writing circuit 14 may include a data writing transistor T1.

The gate of the data writing transistor T1 is electrically connected to the data writing control line S1, the source of the data writing transistor T1 is electrically connected to the data line Data, and the drain of the data writing transistor T1 is electrically connected to the gate of the driving transistor T2.

The first energy storage circuit 13 may include a second capacitor C2.

The first terminal of the second capacitor C2 is electrically connected to the gate of the driving transistor T2, and the second terminal of the second capacitor C2 is electrically connected to the high voltage terminal.

The source of the driving transistor T2 is electrically connected to the second control node Sc2, and the drain of the driving transistor is electrically connected to the anode of the organic light emitting diode O1.

The cathode of O1 is electrically connected to the low voltage terminal.

In the specific embodiment of the pixel circuit shown in FIG. 2, the reset voltage terminal is a high voltage terminal, the first voltage terminal is a high voltage terminal, and the second voltage terminal is a low voltage terminal, which are not limited thereto.

In the specific embodiment of the pixel circuit shown in FIG. 2, all the transistors are p-type thin film transistors, which are not limited thereto.

In the specific embodiment of the pixel circuit shown in FIG. 2, the threshold voltage Vth_2 of T2 is equal to the threshold voltage Vth_6 of T6. Or, the threshold voltage of T2 is approximately equal to the threshold voltage of T6.

In the specific embodiment of the pixel circuit shown in FIG. 2, in the layout, the shape of T2 is consistent with the shape of T6, and the distance between T2 and T6 is close (that is, T2 and T6 are close to each other), so that the threshold voltage of T2 is equal to the threshold voltage of T6 or the threshold voltage of T2 is approximately equal to the threshold voltage of T6.

When the pixel circuit of the specific embodiment shown in FIG. 2 is in operation, in the reset stage, in a case that the potential of the gate of T4 reaches VSS+|Vth_6|, T6 is turned off, so that the potential of the gate of T4 is related to the threshold voltage Vth_6 of T6, and both T3 and T4 operate in the saturation region. Since the current source Is provides the same current for T3 and T4, the change in the potential (i.e., the potential of Sc2) of the source of T4 is equal to the change in the potential of the gate of T4, so that the potential of the source of T2 is related to the absolute value of the threshold voltage of T6. Since the threshold voltage Vth_2 of T2 is equal to the threshold voltage Vth_6 of T6, the drive current of T2 is unrelated to the threshold voltage of T2 in the light emitting stage, thereby compensating the threshold voltage.

Figure 3:
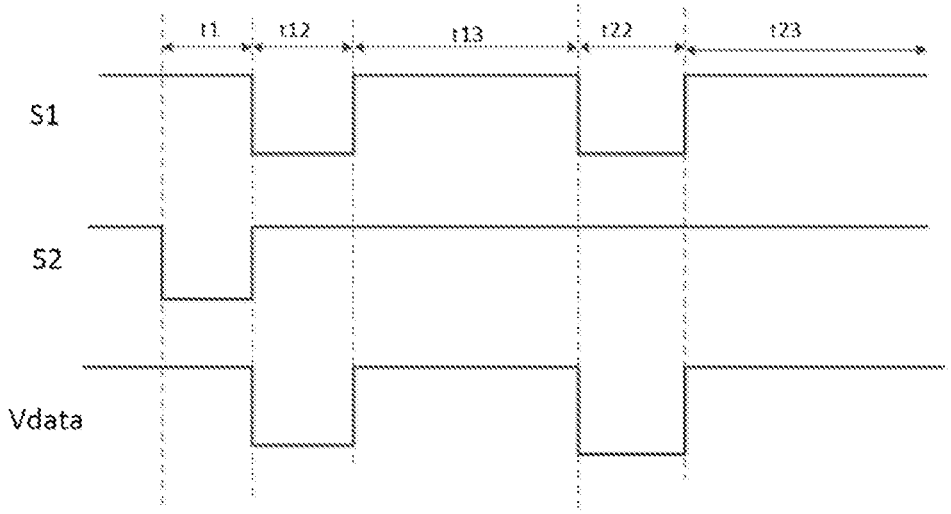
FIG. 3 is an operation timing diagram of a pixel circuit in some embodiments of the present disclosure.

As shown in FIG. 3, when the pixel circuit of the specific embodiment shown in FIG. 2 of the present disclosure is in operation, the display period includes a reset stage t1, a first data writing stage t12, a first light emitting stage t13, a second data writing stage t22 and second light emitting stage t23 in sequence.

In the reset stage, S1 provides a high voltage signal, S2 provides a low voltage signal, T1 is turned off, and T7 is turned on, to reset the potential of the gate of T2 to VDD, so as to control T2 to be turned off; T5 is turned on, to charge C1 by the current flowing through T5, so as to increase the potential of Sc1, until the potential of Sc1 becomes VSS+|Vth_6|, then T6 is turned off, and the potential of Sc1 remains VSS+|Vth_6|; Is provides the current flowing from T3 to T4 to control T3 and T4 to operate in the saturation region, so as to cause the change in the potential of the source of T4 to be equal to the change of that of the gate of T4, so that the potential of Sc2 becomes Vct+VSS+|Vth_6|; Vct is related to VDD, the width to length ratio of T3, and the width to length ratio of T4.

In the first data writing stage t12, S1 provides a low voltage signal, S2 provides a high voltage signal, T7 and T5 are turned off, Data provides a first data voltage Vdata1, and T1 is turned on, to write Vdata1 to the gate of T2.

In the first light emitting stage t13, both S1 and S2 provide high voltages, T1 is turned off, T2 is turned on, and T2 drives O1 to emit light. The driving current Ioled of T2 is as follows:

$$Ioled=\frac{1}{2}\times K(Vct+VSS+|Vth_6|-Vdata1-|Vth_2|)^2$$

$$=\frac{1}{2}\times K(Vct+VSS-Vdata1)^2;$$

Vth_2 is the threshold voltage of T2, the threshold voltage of T2 is equal to the threshold voltage Vth_6 of T6, and K is a current coefficient of T2.

In the second data writing stage t22, S1 provides a low voltage signal, S2 provides a high voltage signal, T7 and T5 are turned off, Data provides a second data voltage Vdata2, and T1 is turned on, to write Vdata2 to the gate of T2.

In the second light emitting stage t23, both S1 and S2 provide high voltages, T1 is turned off, T2 is turned on, and T2 drives O1 to emit light. The driving current Ioled of T2 is as follows:

$$Ioled=\frac{1}{2}\times K(Vct+VSS+|Vth_6|-Vdata2-|Vth_2|)^2$$

$$=\frac{1}{2}\times K(Vct+VSS-Vdata2);$$

Vth_2 is the threshold voltage of T2, the threshold voltage of T2 is equal to the threshold voltage Vth_6 of T6, and K is the current coefficient of T2.

It can be seen from the above formula of driving current that, Ioled is unrelated to the threshold voltage of T2, which can avoid influence of drift of the threshold voltage of T2 on the driving current and make the display uniform.

When the pixel circuit of the specific embodiment shown in FIG. 2 of the present disclosure is in operation, in the first data writing stage t12 and the second data writing stage t12, T2 also drives O1 to emit light. However, since the first data writing stage t12 and the second data writing stage t12 last for a short time, the display may not be affected.

When the pixel circuit of the specific embodiment shown in FIG. 2 of the present disclosure operates, resetting may be performed once for a display time of 4 frames to a display time of 6 frames, and a data writing stage and a light emitting stage may form a display time of one frame.

Figure 4:
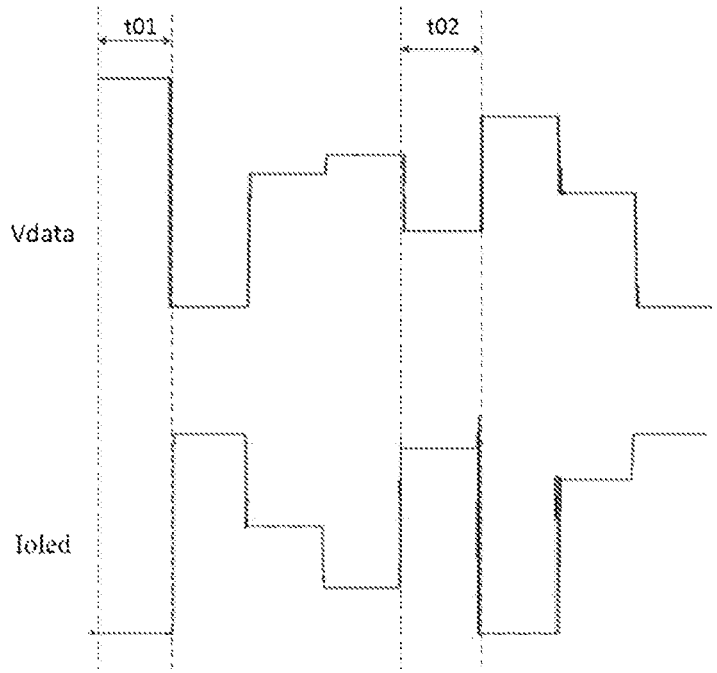
FIG. 4 is a waveform diagram of a data voltage Vdata and a driving current Ioled in a case that a threshold voltage Vth_2 of a driving transistor is −2.5V and a current Ibase provided by a current source Is is 5 μA, when the pixel circuit of the specific embodiment shown in FIG. 2 of the present disclosure is in operation.

As shown in FIG. 4, when the pixel circuit of the specific embodiment shown in FIG. 2 of the present disclosure operates, in a case that Vth_2 is −2.5V and the current Ibase provided by Is is 5 pA, Ioled changes quickly as Vdata changes, which has a high charging rate.

In FIG. 4, the one labeled Ioled is the driving current, the one labeled Vdata is the data voltage, the one labeled t01 is the first reset stage, and the one labeled t02 is the second reset stage.

Figure 5:
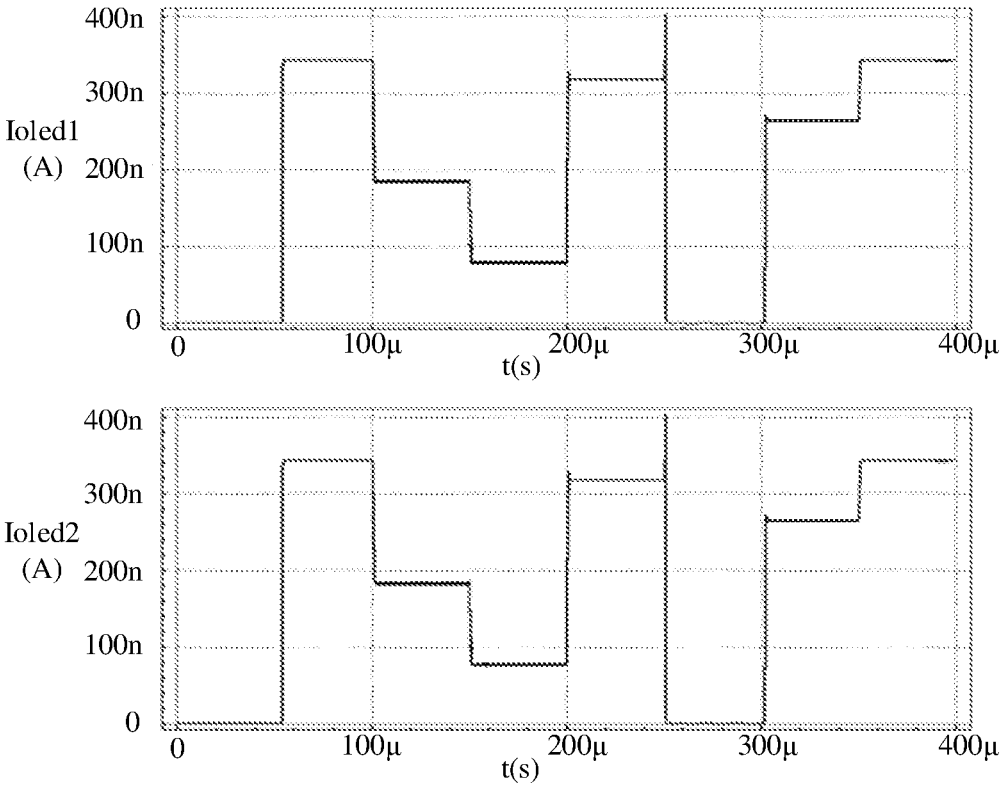
FIG. 5 is a waveform diagram of a first driving current Ioled1 in a case that Vth_2 is −2.5V and of a second driving current Ioled2 in a case that Vth_2 is −2.2V, when the pixel circuit of the specific embodiment shown in FIG. 2 of the present disclosure is in operation.

As shown in FIG. 5, when the pixel circuit of the specific embodiment shown in FIG. 2 of the present disclosure operates, in a case that Vth_2 is −2.5V, the driving current of T2 is the first driving current Ioled1, and in case that Vth_2 is −2.2V, the driving current of T2 is the second driving current Ioled2, where there is no significant difference between Ioled1 and Ioled2. In this way, the pixel circuit according to the embodiments of the present disclosure can realize threshold voltage compensation.

In FIG. 5, the horizontal axis represents time t.

In some embodiments, the current source may include an operational amplifier, a first resistor, a second resistor, a third resistor, and a second storage capacitor.

A non-inverting input terminal of the operational amplifier is electrically connected to an input voltage terminal through the first resistor, a first terminal of the second storage capacitor is electrically connected to the non-inverting input terminal of the operational amplifier, and a second terminal of the second storage capacitor is electrically connected to a third voltage terminal.

An output terminal of the operational amplifier is electrically connected to a first terminal of the second resistor, a second terminal of the second resistor is connected to a first terminal of the third resistor and an inverting input terminal of the operational amplifier, and a second terminal of the third resistor is electrically connected to the third voltage terminal.

The first terminal of the third resistor is electrically connected to the control electrode of the third control transistor and the second electrode of the fourth control transistor.

In specific implementation, the third voltage terminal may be a ground terminal or a low voltage terminal, which is not limited thereto.

Figure 6:
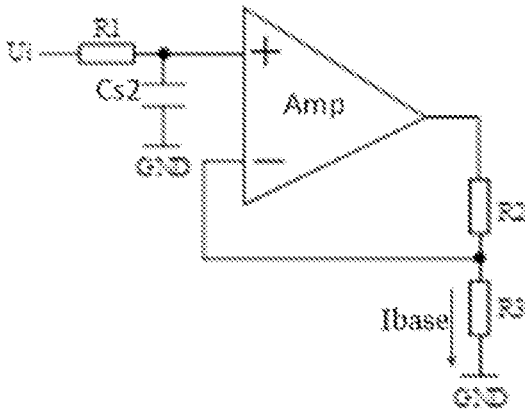
FIG. 6 is a circuit diagram of a current source in some embodiments of the present disclosure.

As shown in FIG. 6, the current source according to an embodiment may include an operational amplifier Amp, a first resistor R1, a second resistor R2, a third resistor R3, and a second storage capacitor Cs2.

The non-inverting input terminal of the operational amplifier Amp is electrically connected to the input voltage terminal through the first resistor R1, and the first terminal of the second storage capacitor Cs2 is electrically connected to the non-inverting input terminal of the operational amplifier Amp. The second terminal of the second storage capacitor Cs2 is electrically connected to the ground terminal GND; the input voltage terminal is configured to provide the input voltage Ui.

The output terminal of the operational amplifier Amp is electrically connected to the first terminal of the second resistor R2, and the second terminal of the second resistor R2 is electrically connected to the first terminal of the third resistor R3 and the inverting input terminal of the operational amplifier Amp. The second terminal of the third resistor R3 is electrically connected to the ground terminal GND.

The first terminal of the third resistor R3 is electrically connected to the gate of the third control transistor and the drain of the fourth control transistor.

In FIG. 6, the current flowing through R3 is Ibase, the current source may be a constant current source, Ibase may be equal to Ui/R3, and Cs2 plays a role of filtering and stabilizing.

Some embodiments of the present disclosure provide a pixel driving method, which is applied to the above mentioned pixel circuit, and the pixel driving method includes:

in a reset stage of a display period, under control of the reset control signal on the reset control line, controlling, by the first voltage control circuit, the potential of the first control node; under control of the potential of the first control node, controlling, by the second voltage control circuit, the potential of the second control node; under control of the reset control signal, resetting, by the reset circuit, the potential of the control terminal of the driving circuit, to cause the driving circuit to disconnect connection between the first terminal of the driving circuit and the second terminal of the driving circuit.

In some embodiments, the controlling, by the first voltage control circuit, the potential of the first control node, under control of the reset control signal on the reset control line includes: under the control of the reset control signal on the reset control line, controlling, by the first voltage control circuit, the potential of the first control node to be related to an absolute value of the threshold voltage of the first control transistor; and the controlling, by the second voltage control circuit, the potential of the second control node, under control of the potential of the first control node includes: under the control of the potential of the first control node, controlling, by the second voltage control circuit, the potential of the second control node to be related to the absolute value of the threshold voltage of the first control transistor.

Some embodiments of the present disclosure provide a pixel driving method, which is applied to the above mentioned pixel circuit, and the pixel driving method includes:

in a reset stage of a display period, under control of the reset control signal on the reset control line, controlling, by the first voltage control circuit, the potential of the first control node to be related to an absolute value of the threshold voltage of the first control transistor; under control of the potential of the first control node, controlling, by the second voltage control circuit, the potential of the second control node to be related to the absolute value of the threshold voltage of the first control transistor; under control of the reset control signal, resetting, by the reset circuit, the potential of the control terminal of the driving circuit, to cause the driving circuit to disconnect connection between the first terminal of the driving circuit and the second terminal of the driving circuit.

The pixel driving method described in the embodiments of the present disclosure can realize the compensation of the threshold voltage of the driving transistor included in the driving circuit, so that the driving current of the driving circuit for driving the light emitting element to emit light is unrelated to the threshold voltage of the driving transistor.

The display period includes the reset stage.

In a specific implementation, the display period further includes N sequential display stages after the reset stage, and the display stage may include a data writing stage and a light emitting stage in sequence; N is a positive integer.

In the data writing stage, under the control of the data writing control signal on the data writing control line, the data writing circuit writes the data voltage to the control terminal of the driving circuit.

In the light emitting stage, under the control of the potential of the control terminal of the driving circuit, the driving circuit generates the driving current for driving the light emitting element to emit light according to the potential of the control terminal and the potential of the first terminal of the driving circuit, and makes the driving current be unrelated to the threshold voltage of the driving transistor included in the driving circuit.

In specific implementation, N may be greater than or equal to 1 and less than or equal to 8, which is not limited thereto. For example, N may be greater than or equal to 2 and less than or equal to 8. More specifically, N may be greater than or equal to 4 and less than or equal to 6. The value of N may be obtained based on simulation calculation or obtained based on experimental testing, which is not specifically limited in the present disclosure.

In some embodiments, the first voltage control circuit includes the first control transistor, a second control transistor, and a first storage capacitor. In the reset stage, the controlling, under the control of the reset control signal on the reset control line, by the first voltage control circuit, the potential of the first control node to be related to an absolute value of the threshold voltage of the first control transistor includes:

in the reset stage, under the control of the reset control signal, the second control transistor is turned on to charge the first storage capacitor by a current flowing through the second control transistor, so as to increase the potential of the first control node, until the potential of the first control node becomes V2+|Vth_6|, where V2 is a second voltage provided by the second voltage terminal, and Vth_6 is the threshold voltage of the first control transistor.

In specific implementation, the second voltage control circuit may include a current source, a third control transistor, and a fourth control transistor.

In the reset stage, the controlling, under the control of the potential of the first control node, by the second voltage control circuit, the potential of the second control node to be related to the absolute value of the threshold voltage of the first control transistor includes:

in the reset stage, the current source provides a current flowing from the third control transistor to the fourth control transistor and controls the third control transistor and the fourth control transistor to operate in a saturation region, to cause a change in a potential of a source of the fourth control transistor to be equal to a change in a potential of a gate of the fourth control transistor, so as to cause the potential of the second control node to be related to the absolute value of the threshold voltage of the first control transistor.

A display device according to embodiments of the present disclosure includes the above mentioned pixel circuit.

The display device provided by the embodiments of the present disclosure may be any product or component with a display function, such as a mobile phone, a tablet computer, a television, a monitor, a notebook computer, a digital photo frame, a navigator, or the like.

Unless otherwise defined, the technical or scientific terms used in the present disclosure shall have the common meanings understood by those of ordinary skill in the art to which the present disclosure belongs. The terms "first", "second", and the like used in the present disclosure do not indicate any order, quantity, or importance, but are only used to distinguish different components. Word such as "including" or "having" means that the element or item listed before the word covers the element or item listed after the word and the equivalent thereof without excluding other elements or items. Word such as "connected" or "coupled" are not limited to physical or mechanical connection, but may include electrical connection, whether direct or indirect. "Up", "down", "left", "right", etc., are only used to indicate the relative position relationship. When the absolute position of the described object changes, the relative position relationship may change accordingly.

The above descriptions illustrate some implementations of the present disclosure. It should be noted that, for those of ordinary skill in the art, without departing from the principles of the present disclosure, various improvements and modifications can be made. These improvements and modifications shall fall with the protection scope of the present disclosure.

What is claimed is:

1. A pixel circuit, comprising a light emitting element, a first voltage control circuit, a second voltage control circuit, a driving circuit, a first energy storage circuit, a data writing circuit, and a reset circuit;

wherein the first voltage control circuit comprises a first control transistor, the driving circuit comprises a driving transistor, and a difference between a threshold voltage of the first control transistor and a threshold voltage of the driving transistor is within a first range;

the first voltage control circuit is configured to control a potential of a first control node under control of a reset control signal on a reset control line;

the second voltage control circuit is electrically connected to the first control node and a second control node, and is configured to control a potential of the second control node under control of the potential of the first control node, and the second control node is electrically connected to a first terminal of the driving circuit;

the first energy storage circuit is electrically connected to a control terminal of the driving circuit, and is configured to store electric energy;

the reset circuit is configured to reset a potential of the control terminal of the driving circuit under control of the reset control signal, to cause the driving circuit to disconnect connection between the first terminal of the driving circuit and the second terminal of the driving circuit;

the data writing circuit is configured to control a data voltage on a data line to be written to the control terminal of the driving circuit under control of a data writing control signal on a data writing control line; and the second terminal of the driving circuit is electrically connected to the light emitting element, and the driving circuit is configured to generate, under control of the potential of the control terminal of the driving circuit, a driving current for driving the light emitting element to emit light.

2. The pixel circuit according to claim 1, wherein the first voltage control circuit is configured to control the potential of the first control node to be related to an absolute value of the threshold voltage of the first control transistor under the control of the reset control signal, and the second voltage control circuit is configured to control the potential of the second control node to be related to the absolute value of the threshold voltage of the first control transistor under the control of the potential of the first control node, so as to cause the driving current to be unrelated to the threshold voltage of the driving transistor.

3. The pixel circuit according to claim 1, wherein the first voltage control circuit comprises a second control transistor and a first storage capacitor;

a control electrode of the second control transistor is electrically connected to the reset control line, a first electrode of the second control transistor is electrically connected to a first voltage terminal, and a second electrode of the second control transistor is electrically connected to the first control node;

a control electrode of the first control transistor and a second electrode of the first control transistor are electrically connected to a second voltage terminal, and a first electrode of the first control transistor is electrically connected to the first control node; and a first terminal of the first storage capacitor is connected to the first control node, and a second terminal of the first storage capacitor is electrically connected to the second voltage terminal.

4. The pixel circuit according to claim 1, wherein the second voltage control circuit comprises a current source, a third control transistor, and a fourth control transistor;

a control electrode of the third control transistor is electrically connected to the current source, a first electrode of the third control transistor is electrically connected to a first voltage terminal, and a second electrode of the third control transistor is electrically connected to the second control node;

a control electrode of the fourth control transistor is electrically connected to the first control node, a first electrode of the fourth control transistor is electrically connected to the second control node, and a second electrode of the fourth control transistor is electrically connected to the current source; and the current source is configured to provide a current flowing from the third control transistor to the fourth control transistor.

5. The pixel circuit according to claim 4, wherein the current source comprises an operational amplifier, a first resistor, a second resistor, a third resistor, and a second storage capacitor;

a non-inverting input terminal of the operational amplifier is electrically connected to an input voltage terminal via the first resistor, a first terminal of the second storage capacitor is electrically connected to the non-inverting input terminal of the operational amplifier, and a second terminal of the second storage capacitor is electrically connected to a third voltage terminal;

an output terminal of the operational amplifier is electrically connected to a first terminal of the second resistor, a second terminal of the second resistor is electrically connected to a first terminal of the third resistor and an inverting input terminal of the operational amplifier, and a second terminal of the third resistor is electrically connected to the third voltage terminal; and the first terminal of the third resistor is electrically connected to the control electrode of the third control transistor and the second electrode of the fourth control transistor.

6. The pixel circuit according to claim 4, wherein the current source is a constant current source.

7. The pixel circuit according to claim 1, wherein the reset circuit comprises a reset transistor; and a control electrode of the reset transistor is electrically connected to the reset control line, a first electrode of the reset transistor is electrically connected to a reset voltage terminal, and a second electrode of the reset transistor is electrically connected to the control terminal of the driving circuit.

8. The pixel circuit according to claim 1, wherein the data writing circuit comprises a data writing transistor; and a control electrode of the data writing transistor is electrically connected to the data writing control line, a first electrode of the data writing transistor is electrically connected to the data line, and a second electrode of the data writing transistor is electrically connected to the control terminal of the driving circuit.

9. The pixel circuit according to claim 1, wherein the first energy storage circuit comprises a second capacitor; and a first terminal of the second capacitor is electrically connected to the control terminal of the driving circuit, and a second terminal of the second capacitor is electrically connected to a first voltage terminal.

10. The pixel circuit according to claim 1, wherein a control electrode of the driving transistor is electrically connected to the control terminal of the driving circuit, a first electrode of the driving transistor is electrically connected to the second control node, and a second electrode of the driving transistor is electrically connected to the light emitting element.

11. The pixel circuit according to claim 1, wherein the threshold voltage of the first control transistor is equal to the threshold voltage of the driving transistor.

12. A pixel driving method, applied to a pixel circuit, wherein the pixel circuit comprises a light emitting element, a first voltage control circuit, a second voltage control circuit, a driving circuit, a first energy storage circuit, a data writing circuit, and a reset circuit;

the first voltage control circuit comprises a first control transistor, the driving circuit comprises a driving transistor, and a difference between a threshold voltage of the first control transistor and a threshold voltage of the driving transistor is within a first range;

the first voltage control circuit is configured to control a potential of a first control node under control of a reset control signal on a reset control line;

the second voltage control circuit is electrically connected to the first control node and a second control node, and is configured to control a potential of the second control node under control of the potential of the first control node, and the second control node is electrically connected to a first terminal of the driving circuit;

the first energy storage circuit is electrically connected to a control terminal of the driving circuit, and is configured to store electric energy;

the reset circuit is configured to reset a potential of the control terminal of the driving circuit under control of the reset control signal, to cause the driving circuit to disconnect connection between the first terminal of the driving circuit and the second terminal of the driving circuit;

the data writing circuit is configured to control a data voltage on a data line to be written to the control terminal of the driving circuit under control of a data writing control signal on a data writing control line;

the second terminal of the driving circuit is electrically connected to the light emitting element, and the driving circuit is configured to generate, under control of the potential of the control terminal of the driving circuit, a driving current for driving the light emitting element to emit light;

the pixel driving method comprises:

in a reset stage of a display period, under control of the reset control signal on the reset control line, controlling, by the first voltage control circuit, the potential of the first control node; under control of the potential of the first control node, controlling, by the second voltage control circuit, the potential of the second control node; under control of the reset control signal, resetting, by the reset circuit, the potential of the control terminal of the driving circuit, to cause the driving circuit to disconnect connection between the first terminal of the driving circuit and the second terminal of the driving circuit.

13. The pixel driving method according to claim 12, wherein the controlling, by the first voltage control circuit, the potential of the first control node, under control of the reset control signal on the reset control line comprises: under the control of the reset control signal on the reset control line, controlling, by the first voltage control circuit, the potential of the first control node to be related to an absolute value of the threshold voltage of the first control transistor; and the controlling, by the second voltage control circuit, the potential of the second control node, under control of the potential of the first control node comprises: under the control of the potential of the first control node, controlling, by the second voltage control circuit, the potential of the second control node to be related to the absolute value of the threshold voltage of the first control transistor.

14. The pixel driving method according to claim 12, wherein the display period comprises: the reset stage and N sequential display stages after the reset stage, and the display stage comprises a data writing stage and a light emitting stage in sequence, where N is a positive integer;

in the data writing stage, under the control of the data writing control signal on the data writing control line, the data writing circuit writes the data voltage to the control terminal of the driving circuit;

in the light emitting stage, under the control of the potential of the control terminal of the driving circuit, the driving circuit generates the driving current for driving the light emitting element to emit light according to the potential of the control terminal and the potential of the first terminal of the driving circuit, and makes the driving current be unrelated to the threshold voltage of the driving transistor comprised in the driving circuit.

15. The pixel driving method according to claim 14, wherein N is greater than or equal to 2 and less than or equal to 8.

16. The pixel driving method according to claim 13, wherein the first voltage control circuit comprises a second control transistor and a first storage capacitor; and in the reset stage, the controlling, under the control of the reset control signal on the reset control line, by the first voltage control circuit, the potential of the first control node to be related to an absolute value of the threshold voltage of the first control transistor comprises:

in the reset stage, under the control of the reset control signal, the second control transistor is turned on to charge the first storage capacitor by a current flowing through the second control transistor, so as to increase the potential of the first control node, until the potential of the first control node becomes $V2+|Vth_6|$, where V2 is a second voltage provided by the second voltage terminal, and Vth_6 is the threshold voltage of the first control transistor.

17. The pixel driving method according to claim 13, wherein the second voltage control circuit comprises a current source, a third control transistor, and a fourth control transistor; and in the reset stage, the controlling, under the control of the potential of the first control node, by the second voltage control circuit, the potential of the second control node to be related to the absolute value of the threshold voltage of the first control transistor comprises:

in the reset stage, the current source provides a current flowing from the third control transistor to the fourth control transistor and controls the third control transistor and the fourth control transistor to operate in a saturation region, to cause a change in a potential of a source of the fourth control transistor to be equal to a change in a potential of a gate of the fourth control transistor, so as to cause the potential of the second control node to be related to the absolute value of the threshold voltage of the first control transistor.

18. The pixel driving method according to claim 12, wherein the threshold voltage of the first control transistor is equal to the threshold voltage of the driving transistor.

19. A display device, comprising a pixel circuit, wherein the pixel circuit comprises a light emitting element, a first voltage control circuit, a second voltage control circuit, a driving circuit, a first energy storage circuit, a data writing circuit, and a reset circuit;

wherein the first voltage control circuit comprises a first control transistor, the driving circuit comprises a driving transistor, and a difference between a threshold voltage of the first control transistor and a threshold voltage of the driving transistor is within a first range;

the first voltage control circuit is configured to control a potential of a first control node under control of a reset control signal on a reset control line;

the second voltage control circuit is electrically connected to the first control node and a second control node, and is configured to control a potential of the second control node under control of the potential of the first control node, and the second control node is electrically connected to a first terminal of the driving circuit;

the first energy storage circuit is electrically connected to a control terminal of the driving circuit, and is configured to store electric energy;

the reset circuit is configured to reset a potential of the control terminal of the driving circuit under control of the reset control signal, to cause the driving circuit to disconnect connection between the first terminal of the driving circuit and the second terminal of the driving circuit;

the data writing circuit is configured to control a data voltage on a data line to be written to the control terminal of the driving circuit under control of a data writing control signal on a data writing control line; and the second terminal of the driving circuit is electrically connected to the light emitting element, and the driving circuit is configured to generate, under control of the potential of the control terminal of the driving circuit, a driving current for driving the light emitting element to emit light.

20. The display device according to claim 19, wherein the first voltage control circuit is configured to control the potential of the first control node to be related to an absolute value of the threshold voltage of the first control transistor under the control of the reset control signal, and the second voltage control circuit is configured to control the potential of the second control node to be related to the absolute value of the threshold voltage of the first control transistor under the control of the potential of the first control node, so as to cause the driving current to be unrelated to the threshold voltage of the driving transistor.

* * * * *